US011230807B2

(12) United States Patent
Barbera et al.

(10) Patent No.: US 11,230,807 B2
(45) Date of Patent: Jan. 25, 2022

(54) COMPOSITIONS AND METHODS FOR TREATING KERATINOUS MATERIAL

(71) Applicant: UNSHRINKIT, INC., Arlington, VA (US)

(72) Inventors: Nathaniel Francis Barbera, Boston, MA (US); Matthew Pendleton Kahn, Boston, MA (US); Zack Nicholas Oakley, Cambridge, MA (US); Aanchal Raj, Chantilly, VA (US); Desiree Alexis Davis Stolar, Arlington, VA (US); Andrew Williams Watt, Houston, TX (US); Mark Wayne Juckett, Bourne, MA (US); Evan Paul Boyst, Belleville, MI (US); Ian Alexander Von Wald, Ann Arbor, MI (US)

(73) Assignee: 52 LAUNCH LLC, Framingham, MA (US)

( * ) Notice: Subject to any disclaimer, the term of this patent is extended or adjusted under 35 U.S.C. 154(b) by 0 days.

(21) Appl. No.: 16/220,393

(22) Filed: Dec. 14, 2018

(65) Prior Publication Data

US 2019/0368120 A1 Dec. 5, 2019

Related U.S. Application Data

(63) Continuation of application No. 15/958,703, filed on Apr. 20, 2018, now abandoned, which is a continuation of application No. 14/689,974, filed on Apr. 17, 2015, now abandoned.

(60) Provisional application No. 61/981,766, filed on Apr. 19, 2014.

(51) Int. Cl.

| | |
|---|---|
| ***D06M 11/76*** | (2006.01) |
| ***D06M 11/52*** | (2006.01) |
| ***D06M 11/84*** | (2006.01) |
| ***D06M 13/148*** | (2006.01) |
| ***D06M 13/165*** | (2006.01) |
| ***D06M 13/224*** | (2006.01) |
| ***D06M 13/252*** | (2006.01) |
| ***D06M 13/285*** | (2006.01) |
| *D06M 101/12* | (2006.01) |

(52) U.S. Cl.

CPC ..... *D06M 11/76* (2013.01); *D06M 11/52* (2013.01); *D06M 11/84* (2013.01); *D06M 13/148* (2013.01); *D06M 13/165* (2013.01); *D06M 13/224* (2013.01); *D06M 13/252* (2013.01); *D06M 13/285* (2013.01); *D06M 2101/12* (2013.01)

(58) Field of Classification Search

CPC ..... D06M 11/52; D06M 11/76; D06M 11/84; D06M 13/148; D06M 13/165; D06M 13/224; D06M 13/252; D06M 13/285; D06M 2101/12

See application file for complete search history.

(56) References Cited

U.S. PATENT DOCUMENTS

| | | | | |
|---|---|---|---|---|
| 2,322,313 | A * | 6/1943 | Phillips | D06M 16/003 435/113 |
| 2,615,783 | A | 10/1952 | Haefele et al. | |
| 2,817,342 | A | 12/1957 | Henkin | |
| 3,480,383 | A * | 11/1969 | Krasny | D06C 29/00 8/127.6 |
| 3,519,383 | A | 7/1970 | Peters | |
| 3,537,809 | A | 11/1970 | Cednas et al. | |
| 3,687,605 | A | 8/1972 | Farmer | |
| 5,891,029 | A | 4/1999 | Matsuoka et al. | |
| 2003/0008799 | A1 | 1/2003 | Barnabas et al. | |
| 2006/0269498 | A1 * | 11/2006 | Malle | A61Q 5/04 424/70.2 |
| 2011/0048447 | A1 | 3/2011 | Muller et al. | |

FOREIGN PATENT DOCUMENTS

| | | | |
|---|---|---|---|
| CN | 1164826 | A | 11/1997 |
| CN | 102102293 | * | 6/2011 |
| CN | 102102293 | A | 6/2011 |
| EP | 0167866 | A2 | 1/1986 |
| JP | 2002155467 | A | 5/2002 |
| WO | 1998048093 | A1 | 10/1998 |
| WO | 200018999 | A1 | 4/2000 |

OTHER PUBLICATIONS

Derwent 2008-N16958 , 2012.* https://www.youtube.com/watch?v=jmsh5m6IYR4 Unshrinkit—Emergency Sweater Saver—tested & formulated to unshrink clothes Apr. 18, 2014.*

* cited by examiner

*Primary Examiner* — Amina S Khan

(74) *Attorney, Agent, or Firm* — Lando & Anastasi, LLP

(57) ABSTRACT

Chemical compositions and techniques for treating wool (and other animal hair-based) fabrics are provided. In particular, compositions and techniques for unshrinking wool fabrics and garments are provided.

19 Claims, 8 Drawing Sheets

COMPOSITIONS AND METHODS FOR TREATING KERATINOUS MATERIAL

CROSS-REFERENCE TO RELATED APPLICATION

This application is a continuation of U.S. Non-Provisional patent application Ser. No. 15/958,703 titled "COMPOSITIONS AND METHODS FOR TREATING KERATINOUS MATERIAL" filed on Apr. 20, 2018, now abandoned, which is a continuation of U.S. Non-Provisional patent application Ser. No. 14/689,974 titled "COMPOSITIONS AND METHODS FOR TREATING KERATINOUS MATERIAL" filed on Apr. 17, 2015, now abandoned, which claims the benefit of priority to U.S. Provisional Patent Application Ser. No. 61/981,766 filed on Apr. 19, 2014, the entire disclosures of which are hereby incorporated herein by reference in their entireties for all purposes.

FIELD OF THE DISCLOSURE

One or more aspects relate to chemical compositions and techniques for treating wool (and other animal hair-based) materials, and in particular for unshrinking animal hair-based fabrics and garments.

BACKGROUND

One major problem associated with clothing made of animal fibers, such as wool and others, is its tendency to shrink when, for example, exposed to water or laundered in an unsuitable manner. While much work has been done in the area of shrink-resistance for these types of fibers and fabrics, and many fibers and garments are pre-treated to resist shrinkage, there is evidence that accidental shrinkage of garments occurs frequently.

SUMMARY

In accordance with one or more aspects, a method for increasing the size of a shrunken material comprising keratinous material is provided. The method may comprise dissolving disulfide bonds in the shrunken material, elongating the shrunken material, and promoting reformation of disulfide bonds in the shrunken material.

In accordance with one or more aspects, a kit for increasing the size of a shrunken garment comprising wool fibers is provided. The kit may comprise a concentrated solution comprising a sulfite-based reducing agent and instructions for use.

In accordance with one or more aspects, a method for unshrinking a garment comprising wool fiber is provided. The method may comprise, introducing the garment to an aqueous solution comprising a sulfite-based reducing agent, rinsing the garment to remove residual reducing agent from the garment, physically stretching the garment, and allowing the material to dry without further physical stress.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

Various aspects of multiple embodiments are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure.

In the figures.

DETAILED DESCRIPTION

Figure 1:
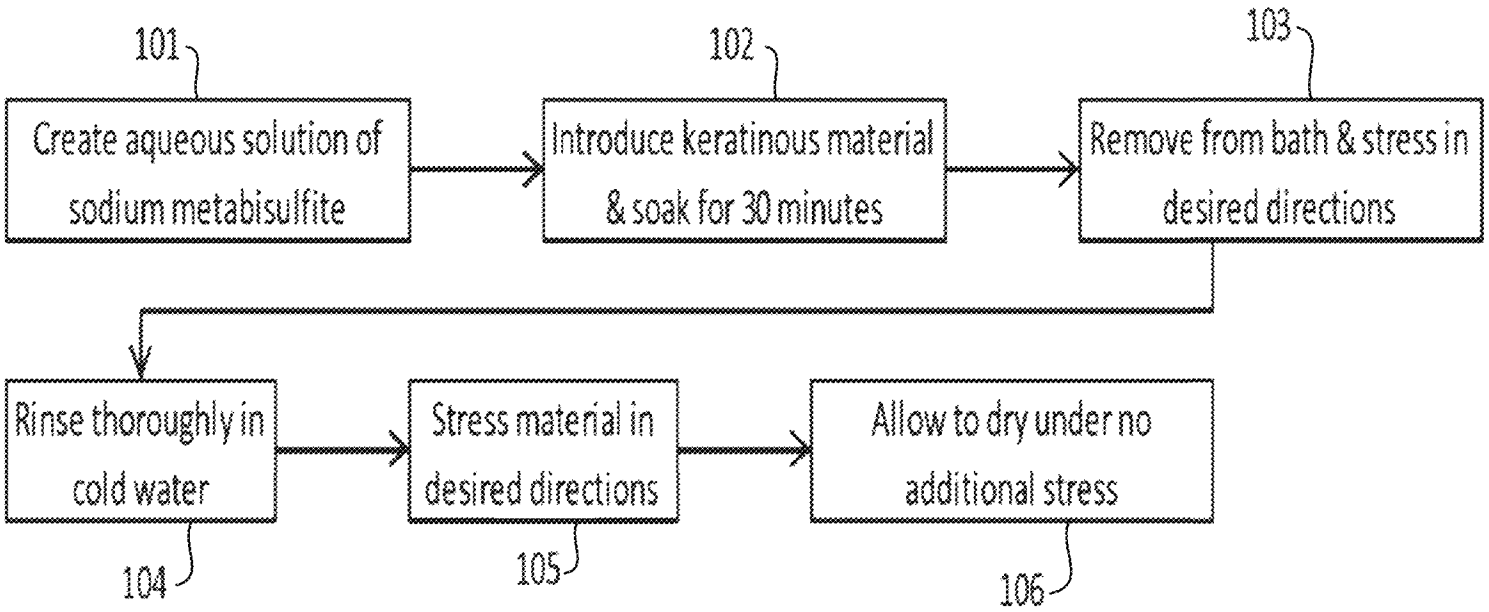
FIG. 1 is a flow chart outlining the steps of a method for treating material according to one or more embodiments.

According to one or more embodiments, methods and compositions are provided for stably elongating animal hair-based material (also referred to as keratinous material) without damaging the material and without the use of additional apparatuses, while maintaining the material's dye washfastness. Disclosed methods provide an improvement in the elongation of the material over other known methods while also maintaining critical features of the fiber, including its dye washfastness and structural integrity. Furthermore, in one or more embodiments, the disclosed methods can be safely used without protective equipment (gloves, mask, etc), do not create an odor, and do not leave any residue in the material. At least some disclosed techniques may be considered one-step approaches for reversing shrinkage.

According to one or more embodiments, the disclosed methods can be practiced on any keratinous material, such as wool, wool fibers, and other animal hairs. These keratinous fibers are typically separated into grades based on the measurement of the diameter of the wool's cross-section, and the present invention can be practiced on any of these materials, which range from less than 15 microns in diameter up to 45 microns. This includes, without limitation, wool from sheep, camel, rabbit, goat, alpaca, and llama, and common names for these fibers include, without limitation, merino, cashmere, alpaca, sheep's wool, lamb's wool, angora, mohair, and quiviot. Materials suitable for the disclosed methods also include, without limitation, fabric and garments made of the aforementioned materials as well as fabric and garments made of these materials in blends with other non-keratinous material. Garments made from wool include, without limitation, jackets, sweaters, shirts, blouses, dresses, scarves, hats, gloves, pants, and socks.

Wool garments are composed of wool fibers that are woven into yarn and knitted or otherwise processed into garments. Wool fibers, in turn, are comprised of proteins. These proteins contain multiple different types of bonds, which control the structure and orientation of the protein and hence, that of the fibers as well. One of the types of bonds, commonly known as a disulfide bond, controls the orientation of the protein but does not otherwise impact the structure of the protein or the fiber. Without wishing to be bound to a particular theory, it is believed that during the processing of wool fibers into yarn, the disulfide bonds are forcibly cleaved, allowing the proteins to be straightened and elongated. This allows the fibers to be elongated as well. Once the process is complete, the disulfide bonds reform and lock the proteins and fibers into their new straightened orientation. In addition, when examined under high magnification, it can be seen that the fibers of new yarn are covered by smooth scales, thereby producing a substantially scaled texture. The yarn is then processed into a garment, and the proteins and fibers stay in their straightened orientation until the garment is shrunk.

Without wishing to be bound to a particular theory, a garment may shrink because the heat, hot water, and agitation of the wash/dry process cleaves the disulfide bonds that hold the proteins and fibers in their straightened orientation and the proteins and fibers then return to their natural orientation, which is curled. Following the wash/dry process, the disulfide bonds again reform naturally and lock the fibers into their curled orientation, which shortens the yarn and shrinks the garment. Also, when examined under high magnification, it can be seen that the scales that were originally present on the yarn are no longer visible and the new surface of the fiber exhibits significant roughness, thereby producing a substantially rough texture.

According to one or more embodiments, the disclosed methods accomplish the desired increase in material size by treating a shrunken garment, and hence the fibers and proteins, with a chemical solution, which includes at least one active ingredient, that cleaves the disulfide bonds in the proteins. According to various embodiments, additional ingredients may be present in the chemical solution. These additional ingredients may or may not also be considered active, according to the particular embodiment. Once the disulfide bonds have been cleaved, the practitioner of the method then physically manipulates the orientation of the proteins and fibers by stretching the garment. This increases the size of the garment. Once the garment has been stretched, the practitioner then rinses the garment in a solvent in order to remove the active ingredient. Once the active ingredient has been removed, the disulfide bonds naturally reform and lock the proteins and fibers into their new configuration. This new configuration of the fibers allows the garment to return to its original size. An additional impact of the disclosed methods, according to one or more embodiments, is that when viewed under high magnification, it can be seen that the scales on the fibers have reappeared and reoriented to a similar orientation and smoothness of the original fiber before being shrunk. The smoothness of the reoriented scales also may help during the physical manipulation step of the process, as the smoother fibers will slide more smoothly against one another and allow for easier manipulation.

According to one or more embodiments, the active ingredient in the chemical solution is a reducing agent. More specifically, any reducing agent that cleaves disulfide bonds will be effective in the practice of certain embodiments of the disclosed methods. In some embodiments, suitable reducing agents may include an aqueous solution of a sulfite-based compound. In at least some non-limiting embodiments, the reducing agent may be, without limitation, sodium metabisulfite, sodium sulfite, potassium sulfite, ammonium sulfite, sodium bisulfite, ammonium bisulfite, and potassium metabisulfite. Additional suitable reducing agents may include, without limitation, Ammonium Thioglycolate, Tris (2-carboxyethyl) phosphine hydrochloride, 2-Mercaptoethanol, and dithiothreitol. Combinations of reducing agents may also be used in various embodiments.

The choice of solvent that is used to remove the active ingredient following the treatment may depend on the active ingredient that is used. The solvent is intended to remove the active ingredient from the treated material. In one specific embodiment of an aqueous solution of sodium metabisulfite, water is used as the solvent. For other active ingredients, an appropriate solvent is selected so that the particular reducing agent or agents used will be removed from the fabric without causing any structural damage or reducing dye washfastness. Solvent may be applied before or after elongation in accordance with various embodiments discussed herein.

There are many considerations to be taken into account when deciding on the active ingredient that cleaves the disulfide bond, as well as the concentration of that active ingredient and any additional ingredients. These considerations include, without limitation: the effectiveness in elongating the material, the amount of time the material must be soaked in the solution, the safety of the solution and the ability to use the solution without protective equipment, the odor of the solution and any odor that remains in the material after performance of the present invention, the dye washfastness, and the effect of the solution on the structural integrity of the material. The preferred formulations have been selected based on testing against those requirements and observation of the results.

In at least some embodiments, the formulation may include an additional ingredient or compound that is selected to improve absorption or acceptance of the active ingredient into the material that is to be treated. In at least some embodiments, this additional compound can be a surfactant. Surfactants function by reducing the surface tension of the liquid, which allows the substrate (keratinous fiber, in this case) to wet. This aids in ensuring that the active ingredient can fully penetrate the keratinous fiber and do so in as short a time as possible. The most desirable surfactants for the present invention would improve the absorption of the specific active ingredient into the keratinous material, reduce the time required to soak the keratinous material in the solution, be safe to use without protective equipment, have no odor or no unpleasant odor, leave no residue in the material after use, and not impact the dye washfastness or compromise the integrity of the material.

There are multiple classes of surfactants: anionic surfactants, nonionic surfactants, cationic surfactants, fluorinated surfactants, and amphoteric surfactants, among others. Tests have been conducted using the above criteria for success, and in some embodiments, nonionic, cationic, and anionic surfactants have been shown to improve the efficacy of the active ingredient. Of the various classes of surfactants, the most efficacious surfactants tested have come from the nonionic surfactant class. Within that class, surfactants from the ethoxylated alcohol, fatty acid ester, and alkyl-polyglucoside families have been shown to work most effectively. In addition, a combination of surfactants from multiple surfactant families may be effective.

According to one or more embodiments, the composition may include an additional ingredient selected to reduce or eliminate the odor that is sometimes present such as what may be associated with the reducing agent. This compound, commonly called a binder, interacts with the odor-causing compound in the solution and ensures that it does not convert to a gas and release into the air, thus preventing the creation of the odor. In at least some embodiments, it has been shown that binders can be used without having any impact on the effectiveness of the present embodiments.

In accordance with one or more embodiments, a higher w/v concentration of the active ingredient (sodium metabisulfite, potassium metabisulfite, etc.) can be used in all solutions if it is offset by adding an additional basic compound such as sodium bicarbonate. In the absence of an additional basic compound, a higher w/v concentration of sodium metabisulfite emits a strong odor and a potentially unsafe level of sulfur dioxide gas. Both the odor and the gas can be controlled by adding sodium bicarbonate, which raises the pH of the solution and reduces the odor and gas emission to acceptable levels. As a result, some embodiments of the chemical solution include a w/v concentration of sodium metabisulfite greater than 2% where this higher concentration is offset by the addition of sodium bicarbonate or other basic material.

Specific non-limiting examples of embodiments of the chemical solution used in practicing the present invention are as follows:

- 0.15%-0.45% w/v sodium metabisulfite, balance is water;
- 0.15%-2.00% w/v sodium metabisulfite, balance is water
- 0.15%-0.45% w/v potassium metabisulfite, balance is water;
- 0.15%-2.00% w/v potassium metabisulfite, balance is water
- 0.30%-2.00% v/v ammonium thioglycolate, balance is water;
- 0.15%-2.00% w/v sodium metabisulfite and 0.067%-2.00% v/v ethoxylated C9-11 alcohols (brand name Linwet 91-6), balance is water;
- 0.15%-2.00% w/v sodium metabisulfite and 0.067%-2.00% v/v ethoxylated C9-11 alcohols (brand name Linwet 91-6) and 0.067%-2.00% v/v sodium decylglucosides hydroxypropyl phosphate (brand name Sugafax D10), balance is water;
- 0.15%-2.00% w/v sodium metabisulfite and 0.067%-2.00% v/v ethoxylated C9-11 alcohols (brand name Linwet 91-6) and 0.067%-2.00% v/v undecyl glucoside (brand name Simulsol SL11W), balance is water; and
- 0.15%-2.00% w/v sodium metabisulfite and 0.08%-1.00% v/v tetrahydroxypropyl ethylenediamine, balance is water.
- 0.15%-2.00% w/v sodium metabisulfite, 0.15%-2.00% sodium bicarbonate, balance is water In each of the specific embodiments of the chemical solution listed above, the corresponding solvent used is water while others are envisioned. In the various above-described embodiments, the following function as reducing agents: sodium metabisulfite, potassium metabisulfite, and ammonium thioglycolate. Ethoxylated C9-11 alcohols, sodium decylglucosides hydroxypropyl phosphate, and undecyl glucoside function as surfactants. Also, tetrahydroxypropyl ethylenediamine serves as a binder, and sodium bicarbonate serves as a basic compound.

Various chemical solutions may be applied according to various methods.

According to at least one embodiment of the disclosed method and referring to FIG. 1, the material is treated with a reducing agent that dissolves the disulfide bonds in the material at step 102. The fabric is then physically stressed to elongate it in step 103. The stressing may comprise stretching the material to or beyond a desired length. At this point the material may be treated with a solvent in order to remove the reducing agent from the fabric in order to allow the disulfide bonds of the fabric to reform in step 104, which allows the material to stabilize in the elongated state. In step 106, the material is allowed to dry without being subjected to continual stress. Alternatively, the material may be thoroughly rinsed prior to any stressing. An additional physical stressing step 105 can be included between step 104 and step 106.

According to one or more embodiments, the chemical solution is formulated and packaged in a concentrated volume and labeled with the instructions to use the formulation and perform the present invention. The first step in this method of use is that the concentrated chemical solution is emptied into a large bin or tub. Next, a specific volume of water is added to the concentrated solution in order to dilute the concentration to the correct concentration. Once this has been done, the material is added to the bin and the chemical solution is absorbed into the material. Referring to FIG. 1, the material is then physically stressed to elongate it in step 103. At this point the material may be treated with a solvent in order to remove the reducing agent from the fabric in order to allow the disulfide bonds of the fabric to reform in step 104, which allows the material to stabilize in the elongated state. In step 106, the material is allowed to dry without being subjected to continual stress. Alternatively, the material may be thoroughly rinsed prior to any stressing. An additional physical stressing step 105 can be included between step 104 and step 106.

Specific non-limiting embodiments of the concentrated chemical solution used in practicing the present invention are:

- 2.00%-28.00% w/v sodium metabisulfite, balance is water;
- 2.00%-28.00% w/v potassium metabisulfite, balance is water
- 4.00%-28.00% v/v ammonium thioglycolate, balance is water;
- 2.00%-28.00% w/v sodium metabisulfite and 1.00%-28.00% v/v ethoxylated C9-11 alcohols (brand name Linwet 91-6), balance is water;
- 2.00%-28.00% w/v sodium metabisulfite and 1.00%-28.00% v/v ethoxylated C9-11 alcohols (brand name Linwet 91-6) and 1.00%-28.00% v/v sodium decylglucosides hydroxypropyl phosphate (brand name Sugafax D10), balance is water;

2.00%-28.00% w/v sodium metabisulfite and 1.00%-28.00% v/v ethoxylated C9-11 alcohols (brand name Linwet 91-6) and 1.00%-28.00% v/v undecyl glucoside (brand name Simulsol SL11W), balance is water;

2.00%-28.00% w/v sodium metabisulfite and 1.10%-14.00% v/v tetrahydroxypropyl ethylenediamine, balance is water; and 2.00%-28.00% w/v sodium metabisulfite, 2.00%-28.00% sodium bicarbonate, balance is water.

According to at least one further embodiment, the chemical solution is formulated and packaged in a concentrated volume and labeled with the instructions to use the formulation and perform the present invention. The chemical solution is applied to the material in a washing machine during the soak or wash cycle of a standard machine wash. This is done by first placing the material to be treated into a standard washing machine. Next, a concentrated version of the chemical solution is added into the machine. The machine is may be set to the pre-wash or soak setting on the machine and started. According to some embodiments the pre-wash or soak cycle may be eliminated. The machine may be set to the gentlest cycle available and to use cold water. When the machine is started, the basin fills with water, the chemical solution is diluted to the correct concentration, and the material is soaked in the chemical solution. After the preset amount of time, the cycle continues and the material is agitated, rinsed, and spun. Once the wash cycle completes, the material is removed from the machine and then physically manipulated in order to elongate it. The material is then allowed to dry without being subjected to continual stress.

In testing, various preferred embodiments have been shown to elongate the material to between 100% and 125% of its original size. There has been no damage detected in the underlying structure, in that no abnormal pilling or degradation has been noted. In addition, the dye washfastness does not appear to be affected by the disclosed process. Furthermore, various embodiments can be used safely without protective equipment, have no odor, and leave no residue in the treated material.

The function and advantages of these and other embodiments will be more fully understood from the following examples. These examples are intended to be illustrative in nature and are not considered to be limiting the scope of the invention. In the following examples, materials are treated with a reducing agent to restore or increase their size.

EXAMPLES

Example 1—Sodium Metabisulfite Treatment Method

Various concentrations of sodium metabisulfite in an aqueous solution comprising 3 L of water at room temperature were tested as the reducing agent. A preferred concentration range of sodium metabisulfite was determined to be one of 0.14%-0.45% w/v concentration. A concentration of less than 0.14% w/v was found to be up to 25% less effective compared with concentrations within the preferred range. A concentration of higher than 0.45% w/v sometimes resulted in the emission of an unpleasant odor that is less pronounced when concentrations within the preferred range were used. However, higher concentrations, such as up to 2% w/v, were still effective for treating fabrics.

Once the reducing agent was dissolved into the water, the keratinous material was introduced into the aqueous solution of sodium metabisulfite. The keratinous material was fully submersed in the solution and slightly agitated for one to two minutes to facilitate absorption into the keratinous material. The keratinous material was then preferably left to soak in the solution for a total of 30 minutes, including the two minutes of agitation. Submersing for less than 30 minutes resulted in 5%-6% less effectiveness of unshrinking compared to submersing for 30 minutes. This process allows the sodium metabisulfite reducing agent to cleave the disulfide bonds in the keratinous material. These bonds, formed between keratins in the keratinous material, are the key barrier to elongation of a shrunken fabric. By cleaving these disulfide bonds, the keratinous material was able to more easily elongate. Moreover, by cleaving these bonds chemically, the remaining structure of the material was less subject to damage during elongation. The chemical reaction of the cleavage of the disulfide bond is shown below:

$$RSSR+HSO_3 \rightarrow RSH+RSSO_3$$

After 30 minutes of submersion, the keratinous material was removed from the solution and excess solution is purged. Following this, the material was stressed in the directions in which elongation was desired. It was found that for maximum elongation, the material is stressed for a minimum of 10 seconds under a force that is sufficient to stretch the garment to or beyond its desired size. However, the amount of force required for elongation to occur is significantly less than would be required for untreated fabrics because the disulfide bonds that normally resist elongation have been dissolved by the reducing agent.

Next, the keratinous material was rinsed thoroughly in cold water (0° C.-10° C.) in order to remove the aqueous solution of sodium metabisulfite. Rinsing with warm or hot water was found to render the treatment up to 25% less effective.

Following the rinse with cold water, excess water was purged and the keratinous material was sometimes stressed once again in the directions in which elongation was desired. Stressing the keratinous material again after the cold water rinse could increase the elongation by up to 66%.

Once this stressing was completed, the material was allowed to dry under no additional stress. It was found that the material did not need to be hung to dry, as the additional stress created when hung was found to be not critical to the process. During this drying period the disulfide bonds were able to reform in the keratinous material because the reducing agent was no longer present to prevent the disulfide bonds from reforming. The reformed bonds were created under no applied stress, which allowed them to remain stable.

The improved properties thus include increased elongation that can return the treated keratinous material to the original size. In addition, the method resulted in no damage to the underlying fibers and showed that the dye washfastness was not impacted.

Example 2—Sodium Metabisulfite in Various Concentrations

Tests were conducted comparing the effectiveness of one reducing agent, sodium metabisulfite, in various concentrations. Water was used as a control. The formulations tested are listed in Table 1 below:

TABLE 1

| Tested Formulations. Solution |
|---|
| 3 L of water |
| 0.04% w/v Sodium Metabisulfite in 3 L of water |
| 0.08% w/v Sodium Metabisulfite in 3 L of water |
| 0.15% w/v Sodium Metabisulfite in 3 L of water |
| 0.30% w/v Sodium Metabisulfite in 3 L of water |
| 0.46% w/v Sodium Metabisulfite in 3 L of water |

The purpose of the experiment was to test the effectiveness of the active ingredient in various concentrations and determine the ideal concentration based on effectiveness, odor, dye washfastness, and structural integrity. The test was conducted in the following manner:

I. Wool squares were cut into nominal 20"×2" rectangles and then measured in two places, accurate to +/−⅛$^{th}$ of an inch. Measurements were length top and length bottom.

II. Wool samples were washed and dried in a hot wash/dry cycle.

III. Wool samples were remeasured, taking the same measurements as in step 1.

IV. Sample solutions were prepared and added to large bins.

V. Four samples were added to each bin, and allowed to soak for 30 minutes.

VI. After 30 minutes, each sample was removed from the bin and purged of excess liquid. Then each sample was rinsed under cold water and physically manipulated for a total of 15 seconds each. This included stretching in the direction of the length of the material.

VII. Each sample was then placed on a rack to dry with no further force being exerted upon it.

VIII. Once dry, the samples were remeasured in the same manner as in step 1.

The result of the experiment showed that the active ingredient is not significantly more effective than water at low concentrations (0.04% and 0.08%). At higher concentrations the active ingredient is substantially more effective. At a concentration of 0.46%, however, there was a strong sulfur odor that was undesirable. The complete results are listed in Table 2 below:

TABLE 2

Results of sodium metabisulfite at various concentrations.

| Solution | Effectiveness | Dye Washfastness | Safety | Structural Integrity | Odor | Residue |
|---|---|---|---|---|---|---|
| 3 L of water | 68% | No color loss | No reaction | No issue | None | None |
| 0.04% w/v Sodium Metabisulfite in 3 L of water | 56% | No color loss | No reaction | No issue | Sulfur odor | None |
| 0.08% w/v Sodium Metabisulfite in 3 L of water | 76% | No color loss | No reaction | No issue | Sulfur odor | None |
| 0.15% w/v Sodium Metabisulfite in 3 L of water | 87% | No color loss | No reaction | No issue | Sulfur odor | None |
| 0.30% w/v Sodium Metabisulfite in 3 L of water | 122% | No color loss | No reaction | No issue | Sulfur odor | None |
| 0.46% w/v Sodium Metabisulfite in 3 L of water | 126% | No color loss | Strong Odor | No issue | Sulfur odor | None |

Example 3—Sodium Metabisulfite in One Concentration and Process Variations

Tests were conducted to determine the efficacy of various process steps to follow when using one concentration of the active ingredient. Water was used as a control. The formulation tested was 0.15% w/v sodium metabisulfite in 3 L of water, and the process variables were the soak time and stretch time.

The test was conducted in the following manner:

I. Wool squares were cut into nominal 20"×2" squares and then measured in two places, accurate to +/−⅛$^{th}$ of an inch. Measurements were length top and length bottom.

II. Wool samples were washed and dried in a hot wash/dry cycle.

III. Wool samples were remeasured, taking the same measurements as in step 1.

IV. Sample solutions were prepared and added to large bins.

V. Four samples were added to each bin, and allowed to soak for either 5 or 30 minutes.

VI. After the pre-specified amount to soak time, each sample was removed from the bin and purged of excess liquid. Then each sample was rinsed under cold water and physically manipulated for a total of either 10 or 30 seconds each.

VII. Each sample was then placed on a rack to dry with no further force being exerted upon it.

VIII. Once dry, the samples were remeasured in the same manner as in step 1.

Figure 8:
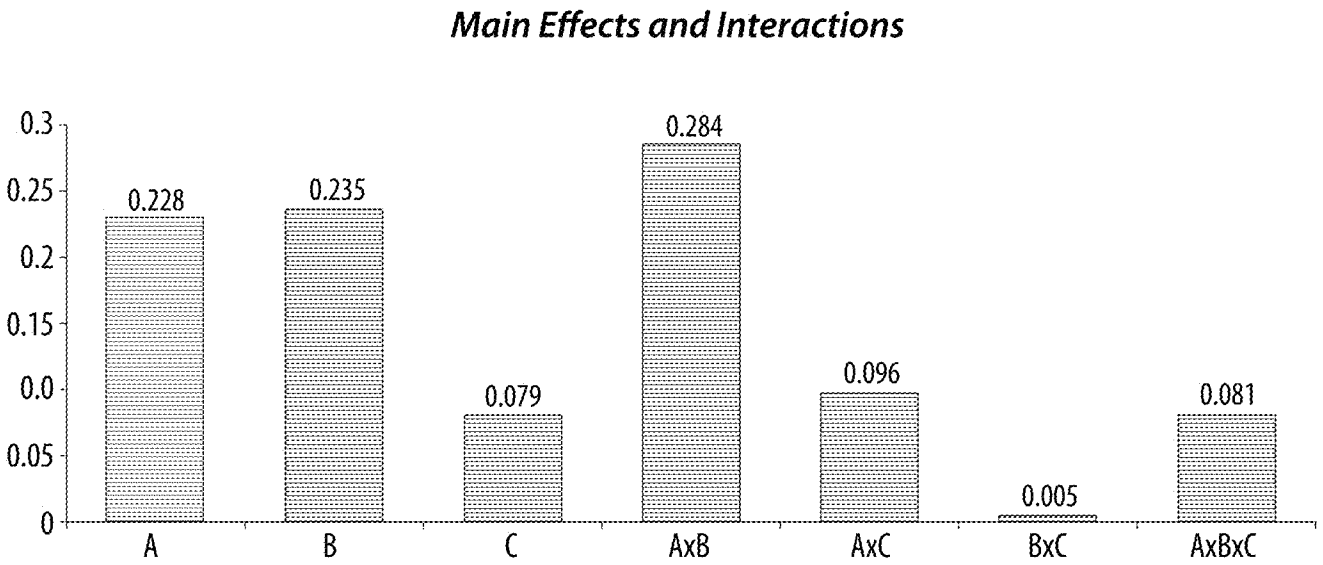
FIG. 8 shows an interaction analysis resulting from the testing of various process parameters.

The result of the experiment showed that the soak time of 30 minutes was substantially more effective than 5 minutes of soak time, and that there was no difference in effectiveness related to stretch time. Finally, the active ingredient performed significantly more effectively than water. Full results are shown in Table 3 below. An interaction analysis is shown in FIG. 8. The interaction analysis shows the degree to which each factor affects final change in size. In this particular analysis, factor A is the solution composition; factor B is soak time; and factor C is stretch time. The graph of FIG. 8 also shows the importance of the combination of factors. For example, the value for A×B indicates the contribution from the combination of solution composition and soak time. The sum total of all contributions adds up to about a value of one. FIG. 8 indicates that among the individual contributions the composition of the solution and the soak time each contribute about three times more to the final product than the stretch time. When viewing the combination of factors, the combination of solution and soak time is the most important contribution.

TABLE 3

Results from Process Variations.

| Solution (A) | soak time (B) | Stretch time (C) | % Unshrunk Trial 1 | % Unshrunk Trial 2 | % Unshrunk Trial 3 | Avg. |
|---|---|---|---|---|---|---|
| water | 5 | 10 sec | 0.5833 | 0.6667 | 0.6548 | 0.6349 |
| water | 5 | 30 sec | 0.7105 | 0.7841 | 0.5857 | 0.6934 |
| water | 30 | 10 sec | 0.6471 | 0.7305 | 0.6071 | 0.6616 |
| water | 30 | 30 sec | 0.4853 | 0.5769 | 0.6458 | 0.5694 |
| 0.45% active | 5 | 10 sec | 0.5278 | 0.625 | 0.5385 | 0.5637 |
| 0.45% active | 5 | 30 sec | 0.5805 | 0.567 | 0.8132 | 0.6535 |
| 0.45% active | 30 | 10 sec | 1.1186 | 1 | 0.8729 | 0.9972 |

TABLE 3-continued

Results from Process Variations.

| Solution (A) | soak time (B) | Stretch time (C) | % Unshrunk Trial 1 | % Unshrunk Trial 2 | % Unshrunk Trial 3 | Avg. |
|---|---|---|---|---|---|---|
| 0.45% active | 30 | 30 sec | 1.6319 | 1 | 1.1429 | 1.2582 |

Example 4—Sodium Metabisulfite and Ammonium Thioglycolate as Active Ingredients

Tests were conducted to compare sodium metabisulfite against another active ingredient, ammonium thioglycolate, in effectiveness, odor, dye washfastness, and structural integrity.

Water was used as a control. The formulations tested are listed in Table 4 below:

TABLE 4

Tested Formulations.

| Solution |
|---|
| 3 L of water |
| 0.3% w/v Sodium Metabisulfite in 3 L of water |
| 0.3% w/v Ammonium thioglycolate in 3 L of water |

The test was conducted in the following manner:

I. Wool squares were cut into nominal 10"×10" squares and then measured in six places, accurate to +/−⅛$^{th}$ of an inch. Measurements were length top, length middle, and length bottom and width left, width middle, and width right.

II. Wool samples were washed and dried in a hot wash/dry cycle.

III. Wool samples were remeasured, taking the same measurements as in step 1.

IV. Sample solutions were prepared and added to large bins.

V. One sample was added to each bin, and allowed to soak for 30 minutes.

VI. After 30 minutes, each sample was removed from the bin and purged of excess liquid. Then each sample was rinsed under cold water and physically manipulated for a total of 30 seconds each. This included stretching in both the length and the width directions.

VII. Each sample was then placed on a rack to dry with no further force being exerted upon it.

VIII. Once dry, the samples were remeasured in the same manner as in step 1.

The result of the experiment showed that the sodium metabisulfite was more effective than the ammonium thioglycolate, but more importantly, the test revealed that the ammonium thioglycolate had a very strong, unacceptable odor.

The complete results are listed in Table 5 below:

TABLE 5

Results from testing of different active ingredients.

| Solution | Effectiveness | Dye Washfastness | Safety | Structural Integrity | Odor | Residue |
|---|---|---|---|---|---|---|
| 3 L of water | 47% | No color loss | No reaction | No issue | None | None |
| 0.30% w/v Sodium Metabisulfite in 3 L of water | 100% | No color loss | No reaction | No issue | Sulfur odor | None |
| 0.30% w/v Ammonium thioglycolate in 3 L of water | 73% | No color loss | Concern about odor safety | No issue | Very strong negative odor | None |

Example 5—Sodium Metabisulfite with Surfactant as Additional Active Ingredient Tests were conducted to compare the effectiveness of two solutions, listed in Table 6 below, with water used as a control.

TABLE 6

Tested solutions.

| Solution |
|---|
| 3 L of water |
| 0.15% w/v Sodium Metabisulfite in 3 L of water |
| 0.15% w/v Sodium Metabisulfite, 0.08% v/v 91-6 in 3 L of water |

The purpose of the experiment was to understand if the specific surfactant additive improved the effectiveness of the active ingredient. The test was conducted in the following manner:

I. Wool squares were cut into nominal 10"×10" squares and then measured in six places, accurate to +/−⅛$^{th}$ of an inch. Measurements were length top, length middle, length bottom, and width left, width middle, width right.

II. Wool samples were washed and dried in a hot wash/dry cycle.

III. Wool samples were remeasured, taking the same measurements as in step 1.

IV. Sample solutions were prepared and added to large bins.

V. Three samples were added to each bin, and allowed to soak for 30 minutes.

VI. After 30 minutes, each sample was removed from the bin, and purged of excess liquid. Then each sample was rinsed under cold water and physically manipulated for a total of 1 minute each. This included stretching both lengthwise and widthwise.

VII. Each sample was then placed on a rack to dry with no further force being exerted upon it.

VIII. Once dry, the samples were remeasured in the same manner as in step 1.

The result of the experiment showed a significant improvement in the effectiveness of the present invention when the surfactant was added to the solution. The complete results are listed in Table 7 below:

TABLE 7

Results from testing.

| Solution | Effectiveness | Dye Washfastness | Safety | Structural Integrity | Odor | Residue |
|---|---|---|---|---|---|---|
| 3 L of water | 44% | No color loss | No reaction | No issue | None | None |
| 0.15% w/v Sodium Metabisulfite in 3 L of water | 59% | No color loss | No reaction | No issue | Sulfur odor | None |
| 0.15% w/v Sodium Metabisulfite, 0.08% v/v 91-6 in 3 L of water | 72% | No color loss | No reaction | No issue | Sulfur odor | None |

Example 6—Sodium Metabisulfite as Active Ingredient Using Test Method in Example 5 with Surfactant or Binder as Additional Active Ingredient An additional test was conducted to compare the effectiveness of the earlier-tested 0.15% w/v sodium metabisulfite in 3 L of water solution with an additive that was intended to eliminate the sulfur odor. The formulations tested are listed in Table 8 below:

TABLE 8

| Tested solutions. Solution |
|---|
| 0.15% w/v Sodium Metabisulfite in 3 L of water |
| 0.15% w/v Sodium Metabisulfite, 0.08% v/v tetrahydroxypropyl ethylenediamine (tertiary amine) in 3 L of water |

In the original formulation of 0.15% w/v of sodium metabisulfite in water, a small amount of sulfur dioxide is released into the air in the form of a gas, which causes an odor. The purpose of the experiment was to understand if the tertiary amine would interact with the sulfur dioxide to prevent it from releasing into the air and also to learn if this addition had any impact on the effectiveness of the formulation. The test was conducted in the same manner as in example five. When tested with a basic olfactory test as well as Gas Chromatography-Mass Spectrometry, there was no presence of sulfur dioxide detected. The addition of the tertiary amine compound was shown to not have any impact, positive or negative, on the effectiveness of the present invention. The complete test results are listed in Table 9 below:

TABLE 9

| Results from testing. | | | | | | |
|---|---|---|---|---|---|---|
| Solution | Effectiveness | Dye Washfastness | Safety | Structural Integrity | Odor | Residue |
| 0.15% w/v Sodium Metabisulfite in 3 L of water | 46% | No color loss | No reaction | No issue | Sulfur odor | None |
| 0.15% w/v Sodium Metabisulfite, 0.08% v/v tetrahydroxypropyl ethylenediamine (tertiary amine) in 3 L of water | 46% | No color loss | No reaction | No issue | No odor | None |

Example 7—Sodium Metabisulfite and Sodium Borate Active Ingredients Using Test Method in Example 5 with a Combination of Surfactants as Additional Active Ingredients Added to Sodium Metabisulfite An additional test was conducted to compare the effectiveness of sodium metabisulfite at 0.15% w/v in 3 L of water solution to a number of additional solutions, listed in the Table 10 below:

TABLE 10

| Tested solutions. Solution |
|---|
| 0.15% w/v Sodium Metabisulfite in 3 L of water |
| 0.15% w/v Sodium Borate in 3 L of water |
| 0.15% w/v Sodium Metabisulfite, 0.17% w/v Sodium Lauryl Sulfate, 0.17% w/v Calfoam SLS-30 in 3 L of water |
| 0.15% w/v Sodium Metabisulfite, 0.17% w/v Sodium Alpha Olefin Sulfonate, 0.17% w/v Calsoft AOS-40 in 3 L of water |
| 0.15% w/v Sodium Metabisulfite, 0.067% w/v 91-6, 0.067% w/v Sugafax D10 in 3 L of water |
| 0.15% w/v Sodium Metabisulfite, 0.067% w/v 91-6, 0.067% w/v Simulsol SL11W in 3 L of water |

The test was conducted in the same manner as in example five. As can be seen from the results below, the addition of 91-6 and either SugaFaxD10 or Simulsol SL11W to the base 0.15% sodium metabisulfite solution had a significant impact on the effectiveness of the present invention.

The complete results of the test are shown in Table 11 below:

TABLE 11

Results from testing.

| Solution | Effectiveness | Dye Washfastness | Safety | Structural Integrity | Odor | Residue |
|---|---|---|---|---|---|---|
| 0.15% w/v Sodium Metabisulfite in 3 L of water | 63% | No color loss | No reaction | No issue | Sulfur odor | None |
| 0.15% w/v Sodium Borate in 3 L of water | 70% | Slight color loss | No reaction | No issue | No odor | None |
| 0.15% w/v Sodium Metabisulfite, 0.17% w/v Sodium Lauryl Sulfate, 0.17% w/v Calfoam SLS-30 in 3 L of water | 72% | Moderate Color Loss | No reaction | No issue | Sulfur odor | None |
| 0.15% w/v Sodium Metabisulfite, 0.17% w/v Sodium Alpha Olefin Sulfonate, 0.17% w/v Calsoft AOS-40 in 3 L of water | 79% | Slight color loss | No reaction | No issue | Sulfur odor | None |
| 0.15% w/v Sodium Metabisulfite, 0.067% w/v 91-6, 0.067% w/v Sugafax D10 in 3 L of water | 102% | No color loss | No reaction | No issue | Sulfur odor | None |
| 0.15% w/v Sodium Metabisulfite, 0.067% w/v 91-6, 0.067% w/v Simulsol SL11W in 3 L of water | 102% | No color loss | No reaction | No issue | Sulfur odor | None |

Example 8—Sodium Metabisulfite as Active Ingredient with Various Surfactants as Additional Active Ingredients—Test Varied to Analyze Scale Length & SEM Tests were conducted to compare the effectiveness of sodium metabisulfite in 0.15% w/v in 3 L of water solution to a number of additional solutions, listed in Table 12 below:

TABLE 12

| Tested solutions. Solution |
|---|
| 0.15% w/v Sodium Metabisulfite in 3 L of water |
| 0.15% w/v Sodium Metabisulfite, 0.17% v/v Caloxamine LO in 3 L of water |

TABLE 12-continued

| Tested solutions. Solution |
|---|
| 0.15% w/v Sodium Metabisulfite, 0.33% v/v Caltaine L-35 in 3 L of water |
| 0.15% w/v Sodium Metabisulfite, 0.17% v/v Calfax DB-45 in 3 L of water |

The test was conducted in the manner listed below:

I. Unwashed wool fabrics were characterized using scanning electron microscopy (SEM) and energy dispersive X-ray analysis (EDXA) for morphology and elemental analysis II. Wools were washed and re-characterized by SEM and EDXA; shrinking was also measured on large scale III. Sample solutions were prepared and added to large bins.

IV. One sample was added to each bin, and allowed to soak for 30 minutes.

V. After 30 minutes, each sample was removed from the bin, and purged of excess liquid. Then each sample was rinsed under cold water and physically manipulated for a total of 1 minute each. This included stretching both lengthwise and widthwise.

VI. Each sample was then placed on a rack to dry with no further force being exerted upon it.

VII. Once the samples were dry, they were re-characterized by SEM and EDXA, and unshrinking was measured on large scale.

Figure 2:
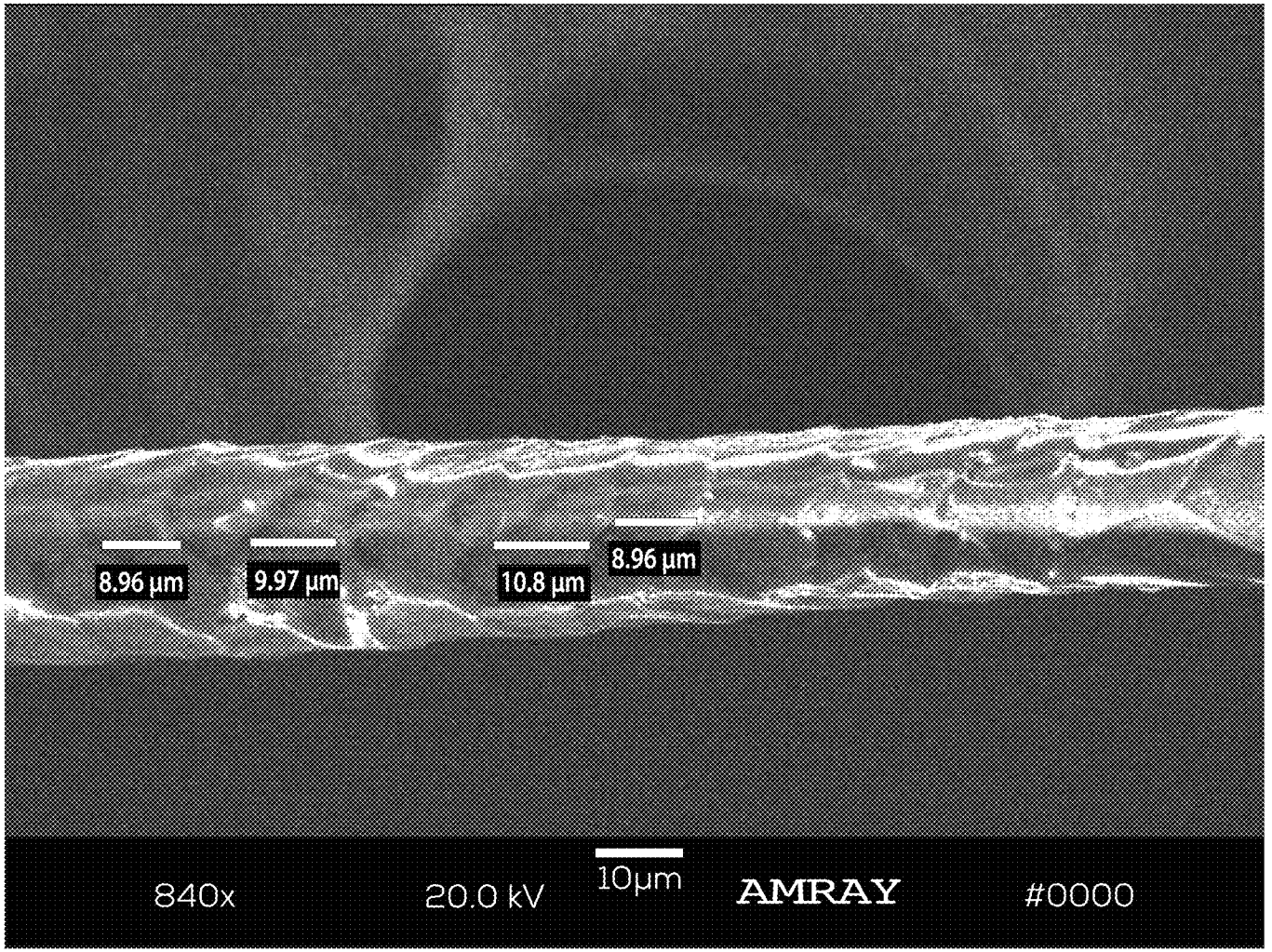
FIGS. 2-7 show microscopic images of material fiber at various stages of treatment according to one or more embodiments.

As can be seen from the SEM image shown in FIG. 2, the untreated wool fibers have a scale length of 9-11 μm and the scales are oriented uniformly along the length of the fibers. FIG. 2 shows a scanning electron microscope image and analysis of untreated wool fiber. After being washed and shrunk, the scales are not clearly visible and the fiber looks as if it has very rugged edges.

When sodium metabisulfite is used as the active ingredient and irrespective of the use of any additional ingredient, the scales on the fibers reappear and are oriented in the same configuration that they were in before being washed.

The length of the scales after treatment with each combination can be found in Table 13 below:

TABLE 13

Results from testing.

| Solution | Scale Length (μm) |
|---|---|
| Untreated Wool | 9-11 |
| 0.15% w/v Sodium Metabisulfite in 3 L of water | 11-16 |
| 0.15% w/v Sodium Metabisulfite, 0.17% v/v Caloxamine LO in 3 L of water | 11-20 |
| 0.15% w/v Sodium Metabisulfite, 0.33% v/v Caltaine L-35 in 3 L of water | 11-15 |
| 0.15% w/v Sodium Metabisulfite, 0.17% v/v Calfax DB-45 in 3 L of water | 15-22 |

Figure 3:
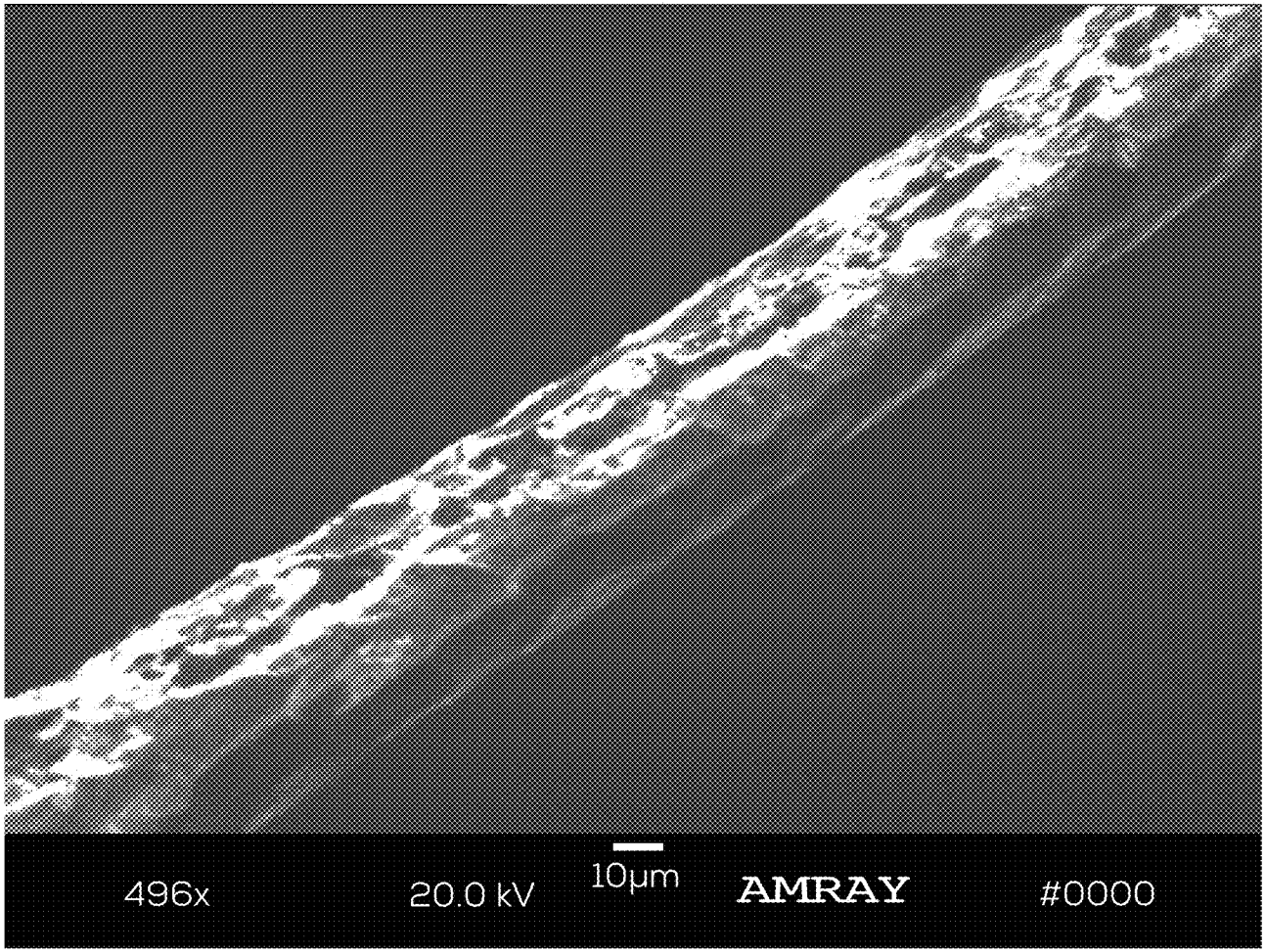

FIG. 3 shows a scanning electron microscope image and analysis of shrunk wool fiber.

Figure 4:
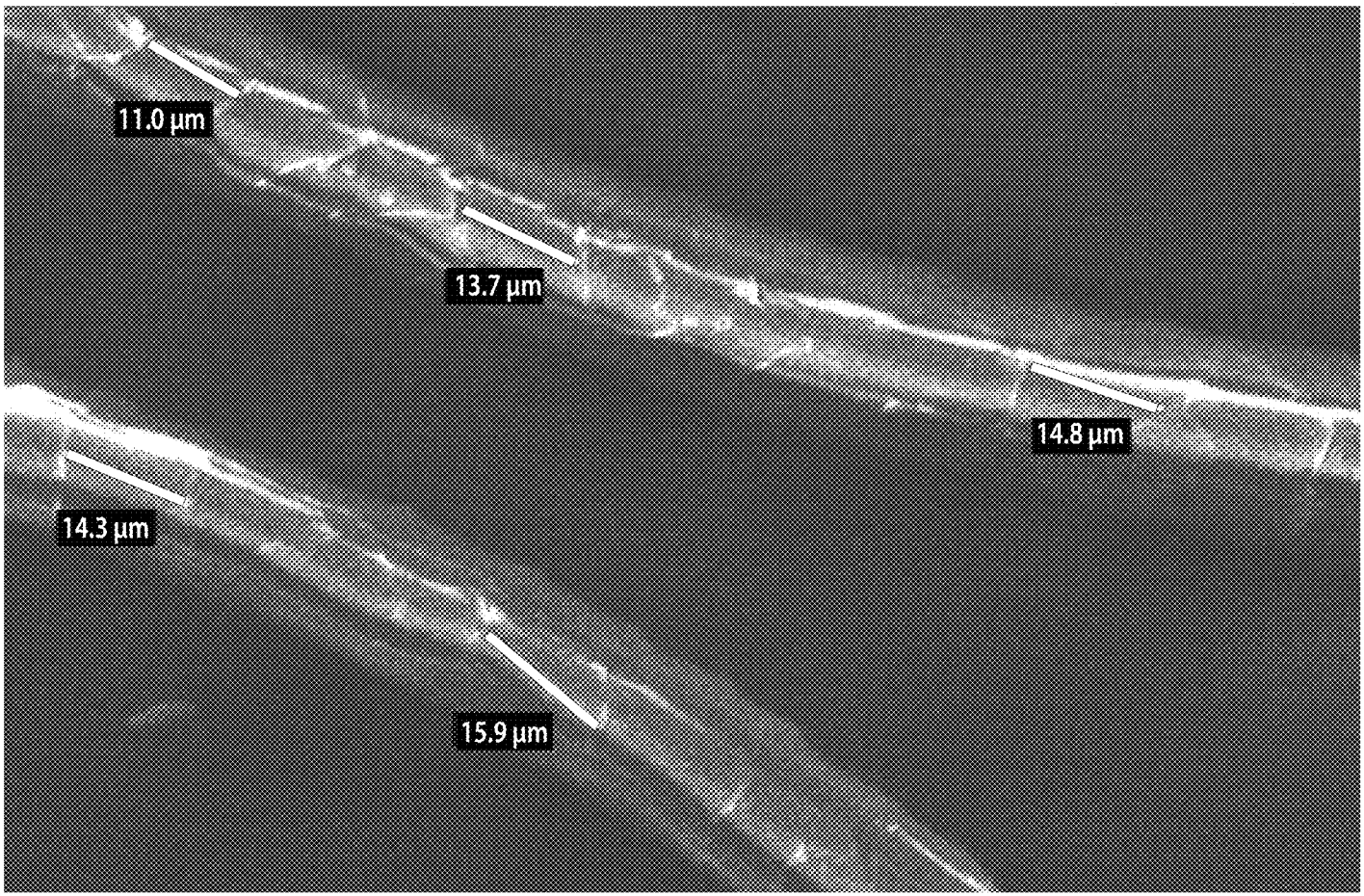

FIG. 4 shows a scanning electron microscope image and analysis of wool fiber treated with 0.15% w/v sodium metabisulfite in 3 L of water.

Figure 5:
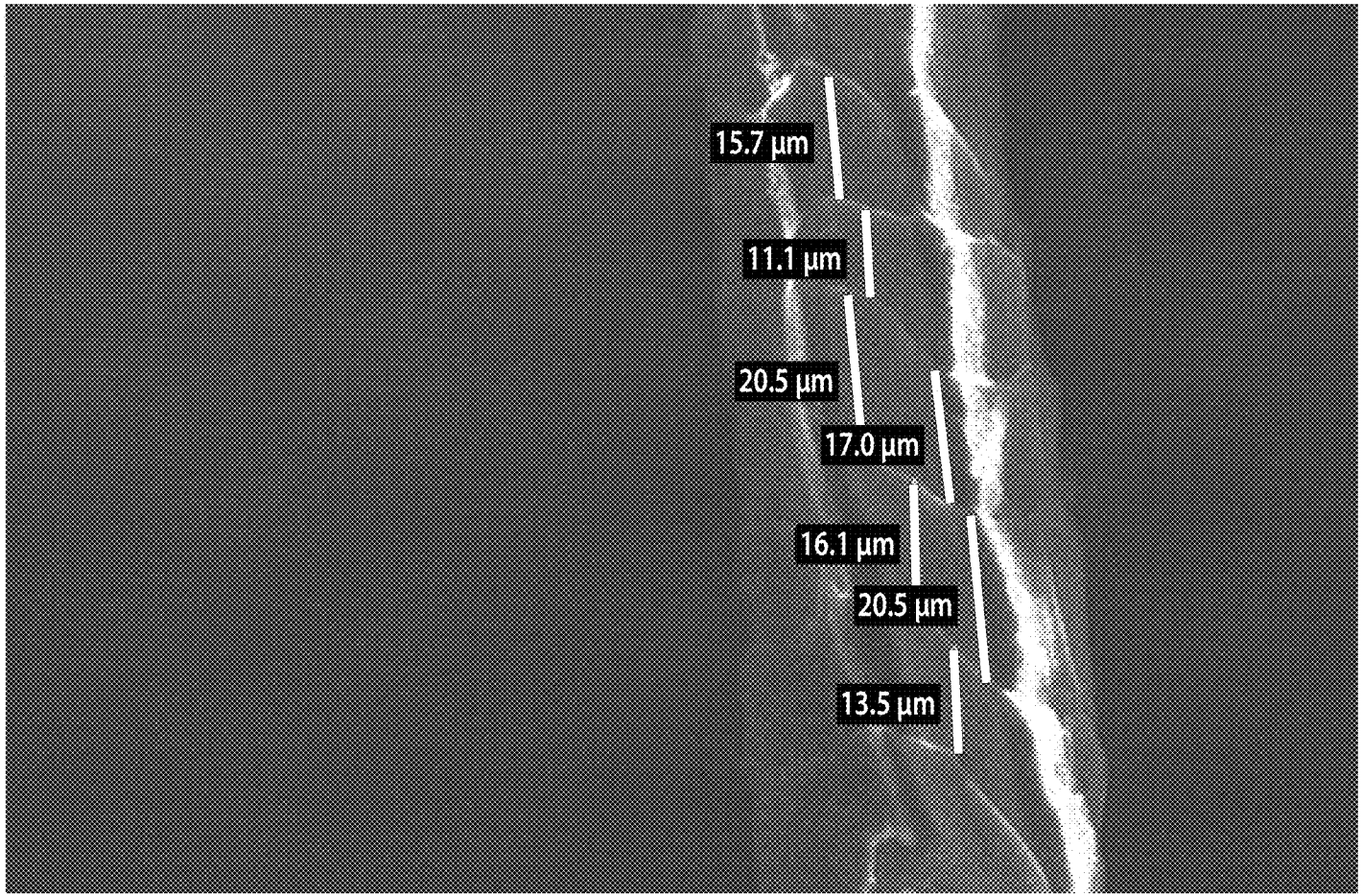

FIG. 5 shows a scanning electron microscope image and analysis of wool fiber treated with 0.15% w/v sodium metabisulfite and 0.17% v/v caloxamine LO in 3 L of Water.

Figure 6:
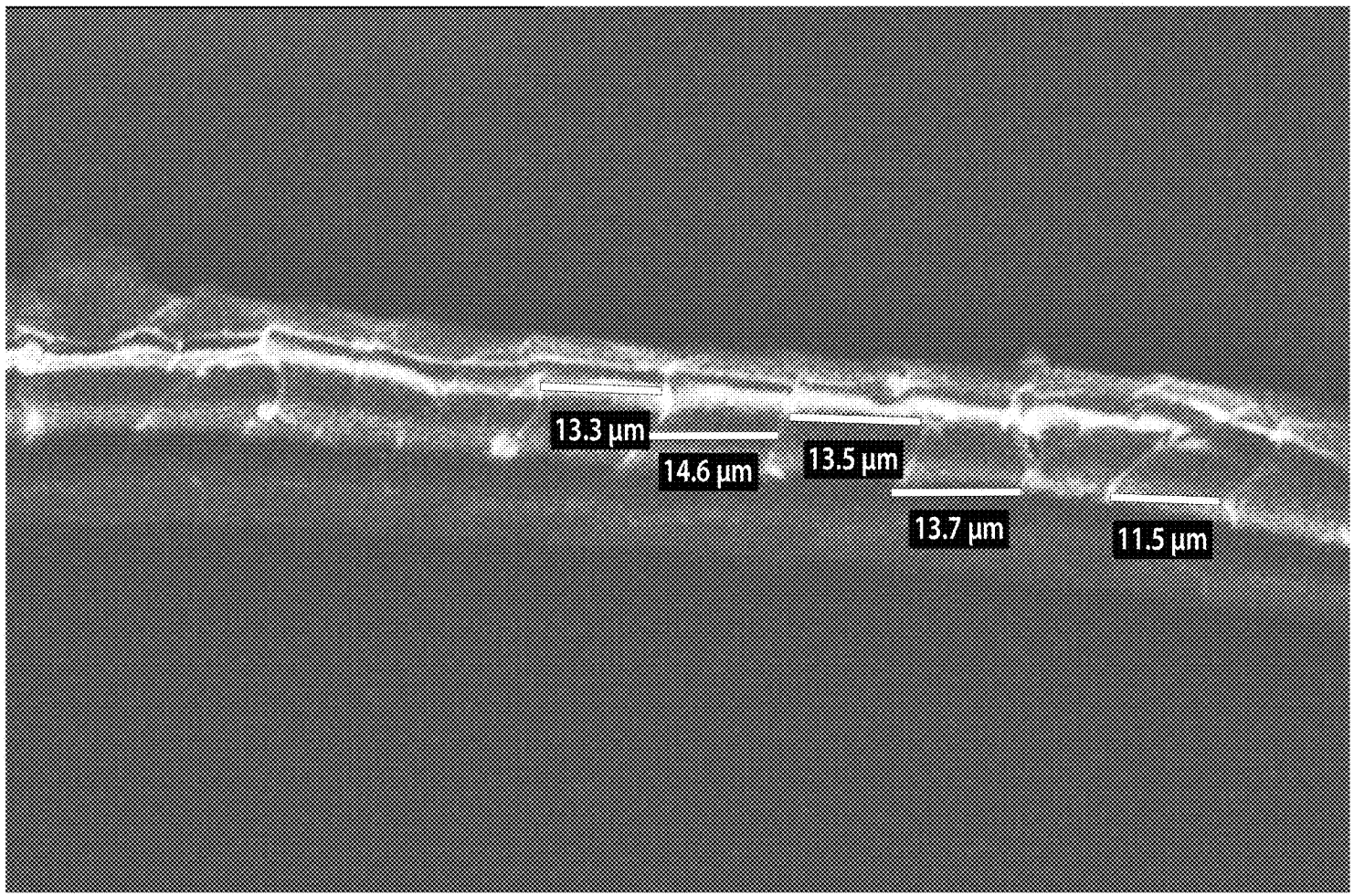

FIG. 6 shows a scanning electron microscope image and analysis of wool fiber treated with 0.15% w/v sodium metabisulfite, 0.33% v/v caltaine L-35 in 3 L of water.

Figure 7:
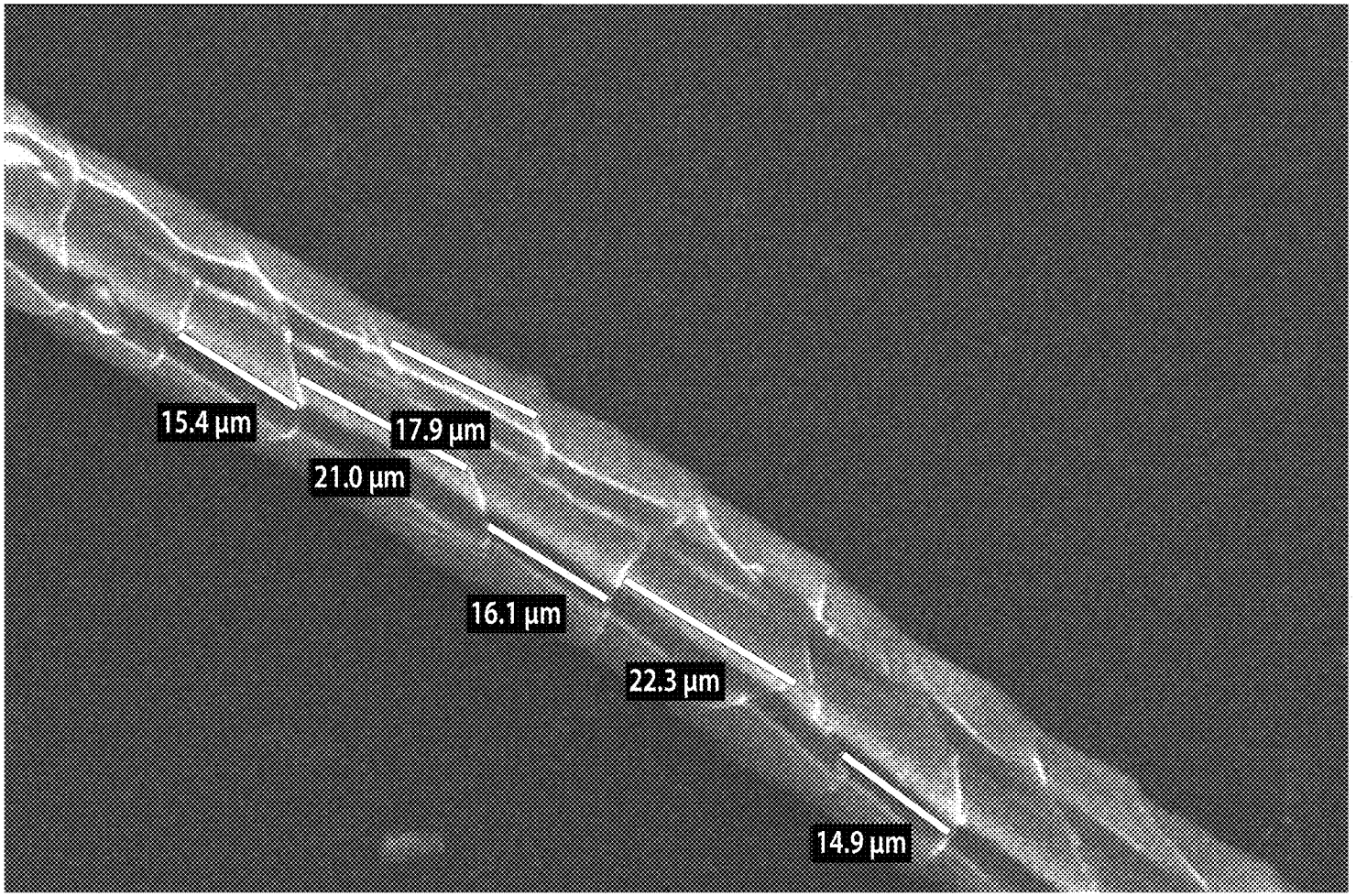

FIG. 7 shows a scanning electron microscope image and analysis of wool fiber treated with 0.15% w/v sodium metabisulfite, 0.17% v/v calfax DB-45 in 3 L of water.

As can be seen from the SEM images and Table 13, the treatments all elongated the scales and recovered the original configuration/orientation of the scales. The reorientation of the scales to make the surface smoother also aids in the elongation process, as a smoother surface allows the wool fibers to slide more easily against each other. These images indicate the function of the present invention at the microscopic level and further support the novelty of the present invention.

Example 9—Sodium Metabisulfite as Active Ingredient with Surfactant as Additional Ingredient Used in Washing Machine Cycle Tests were conducted to compare the effectiveness of sodium metabisulfite and additional surfactants when used in the washing machine instead of the alternative hand-washing process. Water was used as the control.

The formulations tested are listed in the table below:

TABLE 14

Tested solutions.

| Solution |
|---|
| No Treatment (water) |
| Concentrate: 2% w/v Sodium Metabisulfite, 1% w/v 91-6, 1% w/v Simulsol SL11W in 236 mL of water |
| Diluted form: .15% w/v Sodium Metabisulfite, .067% w/v 91-6, .067 w/v Simulsol SL11W |

A concentrated solution was added to the washing machine, allowing the garment to be treated during the normal wash process. The test was conducted in the following manner:

I. Wool squares were cut into nominal 9.5"×9.5" squares and then measured in six places, accurate to +/−⅛$^{th}$ of an inch. Measurements were length top, length middle, length bottom, and width left, width middle, width right.

II. Wool samples were washed and dried in a hot wash/dry cycle.

III. Wool samples were remeasured, taking the same measurements as in step 1.

IV. Sample solution was prepared in a concentrated formulation.

V. The first batch of wool squares, the control samples, were added to the washing machine.

VI. Washing machine was set to 'delicate' cycle setting and started.

VII. After the washing machine cycle completed, the wool samples were removed and physically manipulated for a total of 30 seconds each. This included stretching in both the length and the width directions.

VIII. Each sample was then placed on a rack to dry with no further force being exerted upon it.

IX. The next set of wool squares were then added to the washing machine.

X. The concentrated formulation was added to the washing machine where the detergent is normally added.

XI. Steps VI-VIII were repeated for the second set of samples.

XII. Once dry, the samples were remeasured in the same manner as in Step I.

The result of the experiment showed that the wool squares treated in the sample solution were able to recover 98% of the size that was lost. In addition, there were no observable side effects. Because the treatment was conducted inside the washing machine and then rinsed before removal, no odor was observed. The result of this experiment shows that the method outlined above, in combination with specified reducing agents, can be used as an effective method for returning garments to their original size. The complete results of the test are shown in the table below:

TABLE 15

Results from testing.

| Solution | Effective | Dye Washfastness | Safety | Structural Integrity | Odor | Residue |
|---|---|---|---|---|---|---|
| No Treatment (Water) | 82% | No color loss | No reaction | No issue | None | None |
| Concentrate: 2% w/v Sodium Metabisulfite, 1% w/v 91-6, 1% w/v Simulsol SL11W Diluted form: .15% w/v Sodium Metabisulfite, .067% w/v 91-6, .067 w/v Simulsol SL11W | 98% | No color loss | No reaction | No issue | None | None |

Having now described some illustrative embodiments, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of method acts or composition elements, it should be understood that those acts and those elements may be combined in other ways to accomplish the same objectives.

It is to be appreciated that embodiments of the compositions and methods discussed herein are not limited in application to the details of construction and the arrangement of components set forth in the following description or illustrated in the accompanying drawings. The compositions and methods are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

Moreover, it should also be appreciated that the invention is directed to each feature, composition, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims. Further, acts, elements, and features discussed only in connection with one embodiment are not intended to be excluded from a similar role in other embodiments.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method for unshrinking a shrunken garment comprising wool fiber, the method comprising:

providing a solution comprising a reducing agent, a nonionic surfactant, and an effective amount of a binder to reduce odor;

diluting the solution in water to produce an aqueous solution;

introducing the shrunken garment into the aqueous solution;

allowing the shrunken garment to absorb the aqueous solution forming a soaked garment;

rinsing the soaked garment with a solvent to remove residual reducing agent from the garment;

physically stretching the rinsed garment; and allowing the stretched garment to dry without further physical stress.

2. The method of claim 1, wherein the reducing agent is a sulfite-based reducing agent.

3. The method of claim 1, wherein the reducing agent is selected from the group consisting of: sodium metabisulfite, sodium sulfite, potassium sulfite, ammonium sulfite, sodium bisulfite, ammonium bisulfite, potassium metabisulfite, ammonium thioglycolate, tris (2-carboxyethyl) phosphine hydrochloride, 2-mercaptoethanol, and dithiothreitol.

4. The method of claim 1, comprising diluting the solution in a predetermined volume of the water to produce the aqueous solution.

5. The method of claim 4, wherein the aqueous solution comprises the reducing agent at a concentration from 0.15% to 0.45% weight per volume (w/v).

6. The method of claim 1, further comprising removing excess solvent from the rinsed garment.

7. The method of claim 1, wherein the solvent is selected to prevent structural damage or reduction of dye washfastness.

8. The method of claim 1, wherein the shrunken garment was shrunk by one or more of heat, hot water, and agitation of a wash/dry process.

9. The method of claim 1, wherein the nonionic surfactant is selected from an ethoxylated alcohol, a fatty acid ester, an alkyl-polyglucoside, and combinations thereof.

10. The method of claim 1, wherein the solution comprises a base.

11. The method of claim 10, wherein the base comprises sodium bicarbonate.

12. The method of claim 1, wherein the wool fibers of the stretched garment are 100%-125% elongated as compared to the wool fibers of the garment before shrinking.

13. The method of claim 1, comprising allowing the shrunken garment to absorb the aqueous solution for at least 30 minutes to form the soaked garment.

14. The method of claim 1, wherein the garment is one of a jacket, sweater, shirt, blouse, dress, scarf, hat, glove, pants, and sock.

15. The method of claim 1, wherein the method is performed in a washing machine.

16. The method of claim 1, wherein the method is performed by hand-washing.

17. The method of claim 1, comprising unshrinking a plurality of shrunken garments simultaneously.

18. The method of claim 1, wherein the solvent is cold water at a temperature of about 0° C.-10° C.

19. The method of claim 1, further comprising agitating the soaked garment in the aqueous solution.

* * * * *